US007575303B2

(12) United States Patent
Kato

(10) Patent No.: US 7,575,303 B2
(45) Date of Patent: Aug. 18, 2009

(54) LIQUID-EJECTION HEAD AND METHOD FOR PRODUCING THE SAME

(75) Inventor: Masataka Kato, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 525 days.

(21) Appl. No.: 11/435,441

(22) Filed: May 17, 2006

(65) Prior Publication Data

US 2006/0266733 A1 Nov. 30, 2006

(30) Foreign Application Priority Data

May 24, 2005 (JP) ..... 2005-150860

(51) Int. Cl.
*B41J 2/05* (2006.01)

(52) U.S. Cl. ..... 347/63

(58) Field of Classification Search ..... 347/9, 347/20, 56, 61, 63, 65; 29/890.1, 611; 216/27
See application file for complete search history.

(56) References Cited

U.S. PATENT DOCUMENTS 5,387,314 A * 2/1995 Baughman et al. ..... 216/27
5,478,606 A 12/1995 Ohkuma et al.
6,155,673 A 12/2000 Nakajima et al.
6,481,832 B2 * 11/2002 Liu et al. ..... 347/65
6,749,289 B2 * 6/2004 Matsumoto et al. ..... 347/63
6,910,758 B2 * 6/2005 Truninger et al. ..... 347/47
7,326,356 B2 * 2/2008 Bresciani et al. ..... 216/27
7,416,285 B2 * 8/2008 Kato et al. ..... 347/56

FOREIGN PATENT DOCUMENTS

JP 10-034928 A 2/1998
JP 10-095119 A 4/1998

* cited by examiner

*Primary Examiner*—Anh T. N. Vo
(74) *Attorney, Agent, or Firm*—Canon USA Inc IP Dir

(57) ABSTRACT

A liquid-ejection head includes a substrate, an inlet formed through the substrate, an outlet for ejecting a liquid, a flow channel leading to the outlet, and a pressure-generating part including a pressure-generating element disposed on a surface of the substrate in the flow channel to generate pressure for ejecting the liquid. The flow channel includes a first flow channel defined above the surface of the substrate on which the pressure-generating element is disposed and a second flow channel defined on the substrate down to below the surface on which the pressure-generating element is disposed. The first and second flow channels extend from an opening of the outlet to the pressure-generating element. The second flow channel has a larger width than the first flow channel.

2 Claims, 8 Drawing Sheets

LIQUID-EJECTION HEAD AND METHOD FOR PRODUCING THE SAME

BACKGROUND OF THE INVENTION

1. Field of the Invention

The present invention relates to liquid-ejection recording heads for ejecting a liquid such as ink in droplet form onto a recording material such as paper, and also relates to methods for producing the liquid-ejection recording heads.

2. Description of the Related Art

A typical liquid-ejection head for use in liquid ejection recording includes fine outlets (orifices), flow channels leading to the outlets, and pressure-generating parts disposed in the flow channels to generate ejection pressure. The pressure-generating parts include pressure-generating elements such as electrothermal conversion elements. The electrothermal conversion elements are supplied with drive signals to cause a rapid temperature rise exceeding the nucleate boiling point of the liquid to be ejected, such as ink. The temperature rise generates bubbles in the liquid to produce pressure for ejecting droplets. The electrothermal conversion elements are supplied with drive signals according to recording information to selectively eject the liquid from the outlets.

Liquid-ejection heads capable of providing high-resolution, high-quality images have been in demand particularly in the field of inkjet recording using ink ejection. It is desirable for such liquid-ejection heads to have droplets of reduced size ejected from outlets and to allow the droplets to be ejected at constant volume and ejection speed.

To achieve such liquid ejection, the specification of U.S. Pat. No. 6,155,673 discloses a method for ejecting droplets by allowing bubbles generated by electrothermal conversion elements to communicate with the outside air. According to this method, the size of droplets ejected depends on the size of outlets and the distance between the electrothermal conversion elements and the outlets (hereinafter referred to as "element-outlet distance"), and therefore fine droplets of nearly the same size can be constantly ejected.

For inkjet recording heads based on the method described above, the element-outlet distance may be reduced to eject finer droplets and thereby create higher-resolution images. Also, the element-outlet distance must be accurately defined with high reproducibility to eject droplets of a desired size.

The specification of U.S. Pat. No. 5,478,606 discloses a method for producing an inkjet recording head with a predetermined element-outlet distance defined accurately with high reproducibility. In this method, a flow channel pattern is formed with a soluble resin on a substrate on which pressure-generating elements for generating ejection pressure are formed. The soluble resin layer is then coated with a solution prepared by dissolving in a solvent a coating resin containing an epoxy resin that is solid at room temperature to form a coating resin layer constituting, for example, channel partitions between the individual flow channels. Outlets are then formed in the coating resin layer. Finally, the soluble resin layer is removed by dissolution.

In addition to higher image resolution and quality, higher throughput is demanded of such inkjet recording heads. To achieve higher throughput, the refilling of flow channels with ink after the ejection of droplets must be accelerated so that ejection frequency (drive frequency) can be increased. The reduction in the flow resistance of ink supply channels leading from an inlet to outlets is desired for accelerated refilling.

Liquid-ejection heads having ink supply channels with reduced flow resistance are disclosed in Japanese Patent Laid- Open Nos. 10-095119 and 10-034928. These publications disclose liquid-ejection heads in which the height of ink supply channels is larger near an inlet than near pressure-generating elements and methods for producing the liquid-ejection heads. According to the methods disclosed in these publications, a portion of a substrate from near the inlet to near the pressure-generating elements is trimmed to relatively increase the channel height near the inlet. This increases the cross-sectional area of the ink supply channels to reduce the flow resistance thereof. Thus, the methods disclosed in these publications propose an effective approach to achieving higher throughput.

For the method disclosed in U.S. Pat. No. 5,478,606, however, simply trimming the substrate more deeply for reduced flow resistance causes the following problem. The soluble resin layer having the flow channel pattern is depressed on a trimmed portion of the substrate, and thus the overlying coating resin layer is thickened on the depressed portion. As a result, the channel height is decreased by the increase in the thickness of the coating resin layer.

On the other hand, increasing the cross-sectional area of the flow channels in the lateral direction thereof, rather than in the depth direction thereof, undesirably poses difficulty in increasing the density at which the outlets are arranged.

SUMMARY OF THE INVENTION

The present invention is directed to a liquid-ejection head. According to one aspect of the present invention, a liquid-ejection head includes a substrate, an inlet formed through the substrate to externally supply a liquid to the liquid-ejection head, an outlet adapted to eject the liquid, a flow channel leading to the outlet to guide the liquid supplied through the inlet to the outlet, and a pressure-generating part including a pressure-generating element disposed on a surface of the substrate in the flow channel to generate pressure for ejecting the liquid. The flow channel includes a first flow channel defined above the surface of the substrate on which the pressure-generating element is disposed and a second flow channel defined on a portion of the substrate from an opening of the outlet to near the pressure-generating element so as to have a larger width than the first flow channel.

Further features of the present invention will become apparent from the following description of exemplary embodiments with reference to the attached drawings.

BRIEF DESCRIPTION OF THE DRAWINGS

FIG. 2A is a sectional view taken in the same direction as FIG. 1. FIG. 2B is a partial enlarged view of FIG. 2A. FIG. 2C is a sectional view taken along line IIC-IIC in FIG. 2B. FIG. 2D is a top view of the substrate.

FIG. 5A is a sectional view taken in the same direction as FIG. 1. FIG. 5B is a partial enlarged view of FIG. 5A. FIG. 5C is a sectional view taken along line VC-VC in FIG. 5B.

FIG. 6A is a top view of the flow channels. FIG. 6B is a sectional view taken along line VIB-VIB in FIG. 6A.

FIG. 8A is a sectional view taken in the same direction as FIG. 7. FIG. 8B is a partial enlarged view of FIG. 8A. FIG. 8C is a sectional view taken along line VIIIC-VIIIC in FIG. 8B.

FIG. 9A is an enlarged sectional view taken in the same direction as FIG. 7 and corresponding to FIG. 8B. FIG. 9B is a sectional view taken along line IXB-IXB in FIG. 9A.

FIG. 10A is an enlarged sectional view taken in the same direction as FIG. 7 and corresponding to FIGS. 8B and 9A. FIG. 10B is a sectional view taken along line XB-XB in FIG. 10A.

DESCRIPTION OF THE EMBODIMENTS

Embodiments of the present invention will now be described with reference to the drawings.

First Embodiment

A method for producing an inkjet recording head according to a first embodiment of the present invention is described below with reference to FIGS. 1 to 6.

Figure 1:
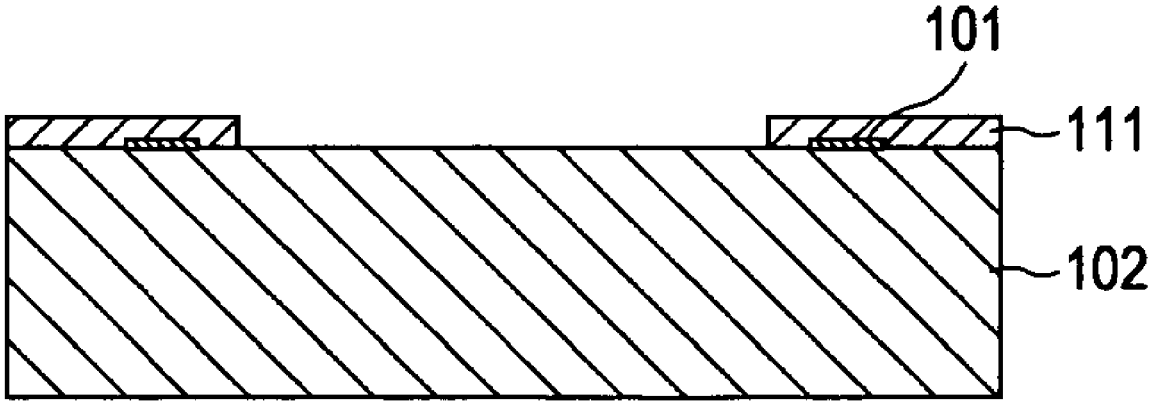
FIG. 1 is a sectional view taken along line I-I in FIG. 2D, illustrating the initial step of a method for producing a liquid-ejection head according to a first embodiment of the present invention.

Referring to FIG. 1, the inkjet recording head produced by the method according to this embodiment includes a silicon substrate 102 on which pressure-generating elements 101 for generating pressure for ejecting ink (liquid) are formed. The substrate 102 has a semiconductor circuit including, for example, transistors for driving the pressure-generating elements 101 and electrode pads for electrically connecting the recording head to a recording device, although these components are omitted in the drawings for convenience of illustration. After the substrate 102 is prepared, in the method according to this embodiment, a mask 111 is formed thereon to form second flow channels 103.

Figure 2A:
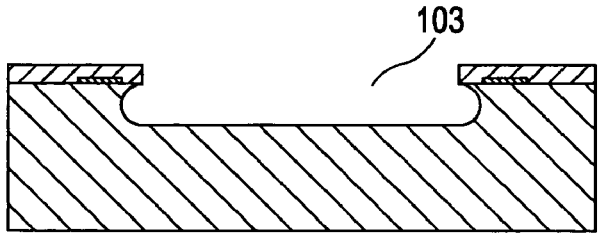
FIGS. 2A to 2D are diagrams of second flow channels defined by forming a recess on a top surface of a substrate by dry etching.
Figure 2B:
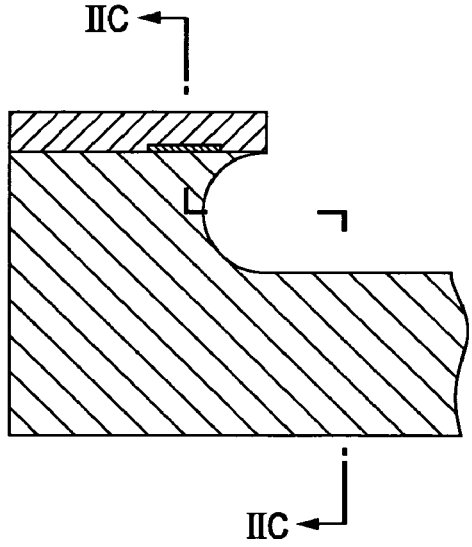
Figure 2C:
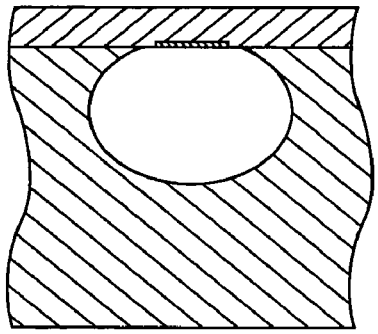
Figure 2D:
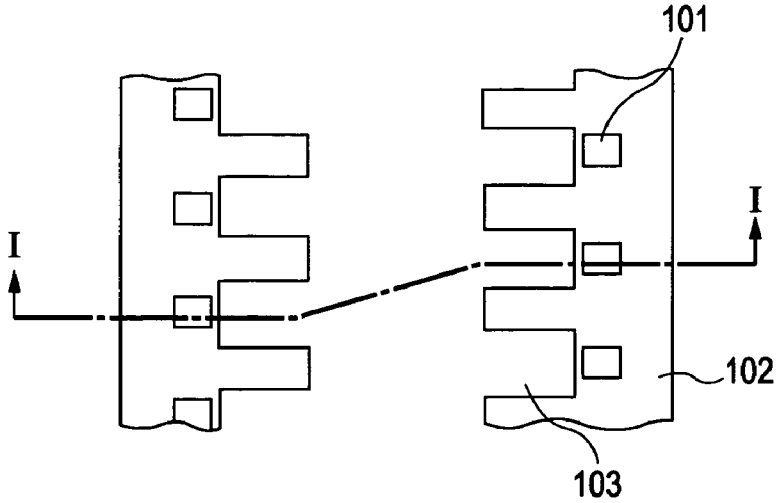

FIGS. 2A to 2D illustrate the second flow channels 103, which are defined on the substrate 102 by forming a recess through dry etching using an electron cyclotron resonance (ECR) dry etching apparatus. When a deep recess is formed on a substrate, the cross-sectional shape thereof varies depending on sidewall temperature and the mask used. In this embodiment, the mask 111 for dry etching may be formed of a general novolac positive resist. In typical dry etching, substances released from a resist and a substrate react with each other, and the products are deposited on the sidewalls of the etched pattern to form a sidewall protective film which may be used for anisotropic etching. In this embodiment, the positive resist is patterned and hard-baked at a high temperature, namely the glass transition temperature (Tg) thereof or higher, so that the resist improves its resistance to etching and thus no longer deposits the sidewall protective film. As a result, the etching progresses to the inside of the mask 111 to form a recess having a bowed shape, as shown in FIG. 2C.

In this embodiment, directional etching is performed by ion etching. A plasma source for generating ions is separated from a reaction chamber in which the etching is performed with accelerated ions. An ECR ion source, which can generate ions at high density, allows the substrate 102 to be anisotropically etched perpendicularly to the surface thereof. If an excess of active species contributing to the etching is supplied and scattered, the sidewalls of the recess can be further etched to form the bowed shape as shown in FIG. 2C. This process provides an inkjet head body having second flow channels wider than first flow channels.

Although the second flow channels 103 are formed by dry etching with an ECR ion source in this embodiment, the recess may also be formed by other methods, including dry etching with other types of plasma sources and wet etching such as crystal anisotropic etching. With an inductively coupled plasma (ICP) dry etching apparatus, for example, a recess is formed on the substrate 102 by alternately performing coating and etching steps (deposition/etching process). According to a specific embodiment based on the deposition/etching process, an etchant, $SF_6$, and a coating gas are alternately supplied to the inner surface of the recess. The etchant ions are directed to the bottom surface of the recess to physically and chemically remove the coating and part of the underlying substrate 102 over the bottom surface of the recess. In this specific embodiment, the ions break through the coating over the bottom surface of the recess within several seconds, depending on the amount of coating deposited. The sidewalls of the recess are negligibly coated because the time for coating is shorter than usual. As a result, the sidewalls are etched in the etching step to form the bowed shape as shown in FIG. 2C. The amount of coating deposited on the sidewalls may also be reduced by heating the substrate 102 to suppress the deposition of coating on the sidewalls.

The second flow channels 103 are thus defined by trimming the top surface of the substrate 102, on which the pressure-generating elements 101 are formed, from an opening of an inlet 108 (see FIG. 4) to near the pressure-generating elements 101.

The second flow channels 103 extend on the substrate 102 from the inlet 108 to near the pressure-generating elements 101. A channel-defining member (orifice plate) 105 having outlets 109 opposite the pressure-generating elements 101 is disposed on the substrate 102 to define first flow channels 110 (see FIGS. 5A to 5C). The ink supply channels of the inkjet recording head according to this embodiment include the first flow channels 110, which are defined by the channel-defining member 105, and the second flow channels 103, which are defined by trimming the substrate 102.

Figure 3:
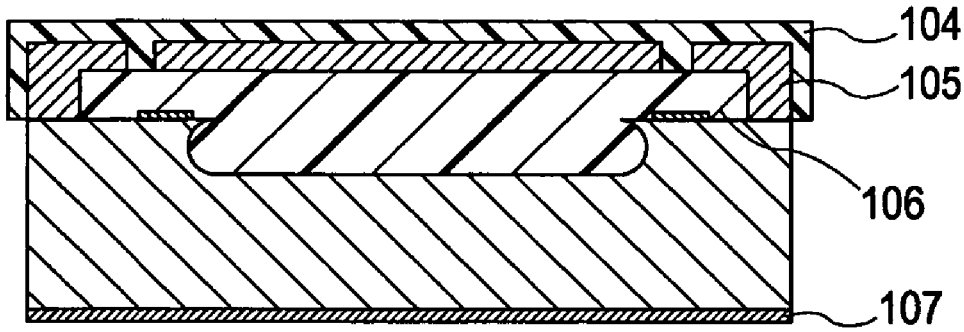
FIG. 3 is a sectional view taken in the same direction as FIG. 1, showing the substrate after a channel pattern member is formed with a UV resist, an orifice plate is formed with a negative resist, a protective layer is formed with a resin containing a cyclic rubber, and a back mask layer is formed with a polyether amide.

Next, the top surface of the substrate 102 is coated by spin coating with a solution containing a solvent and polymethyl isopropenyl ketone, a UV resist that can be dissolved in a subsequent step. The resist is exposed to ultraviolet light and is developed to form a channel pattern member 106, as shown in FIG. 3.

The channel pattern member 106 is then coated with a cationically polymerizable epoxy resin, a type of negative resist, to form the channel-defining member 105, which constitutes channel ceilings and channel partitions. The negative resist is exposed through a photomask with a predetermined pattern and is developed to remove the portions corresponding to the outlets 109 and the electrode pads.

The channel-defining member 105 is then coated with a protective resin 104 containing a cyclized rubber to protect a nozzle part of the head body. On the other hand, the bottom surface of the substrate 102 is coated with a polyether amide. A resist is then formed thereon and is patterned to form an opening in a predetermined region opposite the center of the recess on the top surface of the substrate 102. The polyether amide coating on the bottom surface of the substrate 102 is patterned by dry etching using the resist as a mask, and the resist is then removed. As a result, a back mask layer 107 having an opening for defining the inlet 108 is formed.

Figure 4:
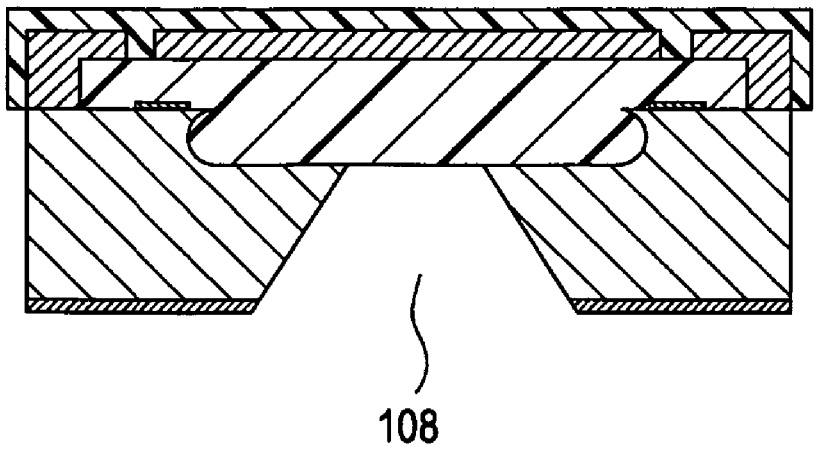
FIG. 4 is a sectional view taken in the same direction as FIG. 1, showing the substrate after an inlet is formed by anisotropically etching the substrate from an opening of the back mask layer to the recess on the top surface of the substrate.

The substrate 102 is then subjected to crystal anisotropic etching through the opening of the back mask layer 107 by dipping the bottom surface of the substrate 102 into a mixture of nitric acid, hydrofluoric acid, and acetic acid. The etching progresses to the recess on the top surface of the substrate 102 to form the inlet 108 (FIG. 4).

Figure 5A:
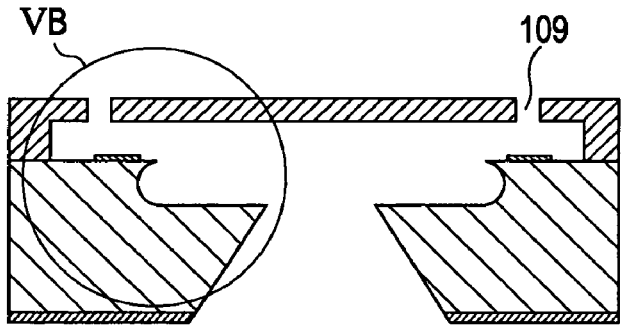
FIGS. 5A to 5C are sectional views of an inkjet head body having desired flow channels formed by removing the protective layer and the channel pattern member.
Figure 5B:
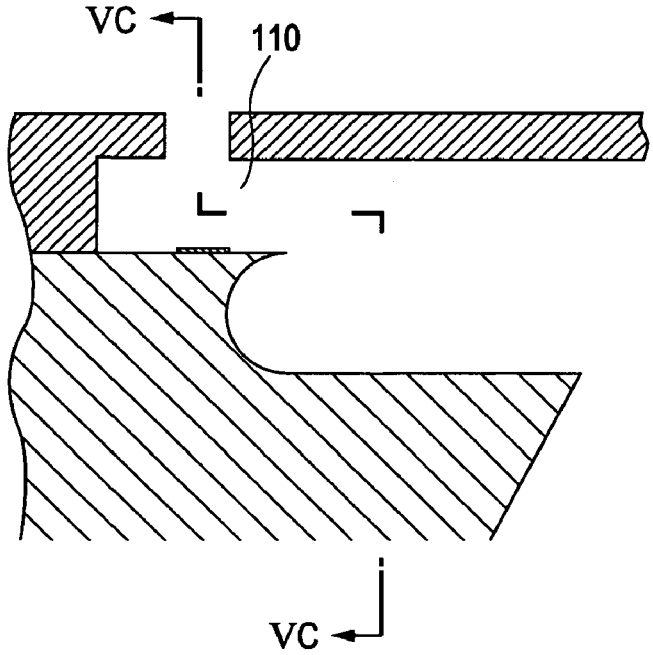
Figure 5C:
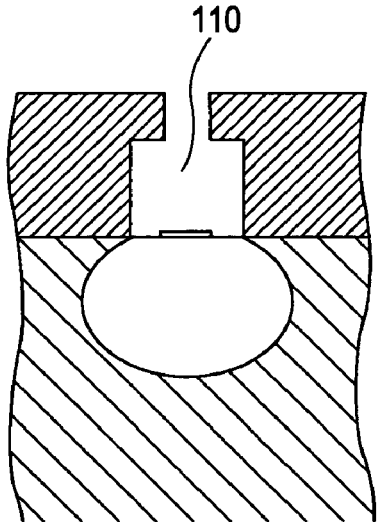

The protective resin 104 on the top of the head body is removed with xylene. The substrate 102 is dipped in methyl lactate and is treated with ultrasound to dissolve and remove the UV resist constituting the channel pattern member 106 (FIGS. 5A to 5C).

Figure 6A:
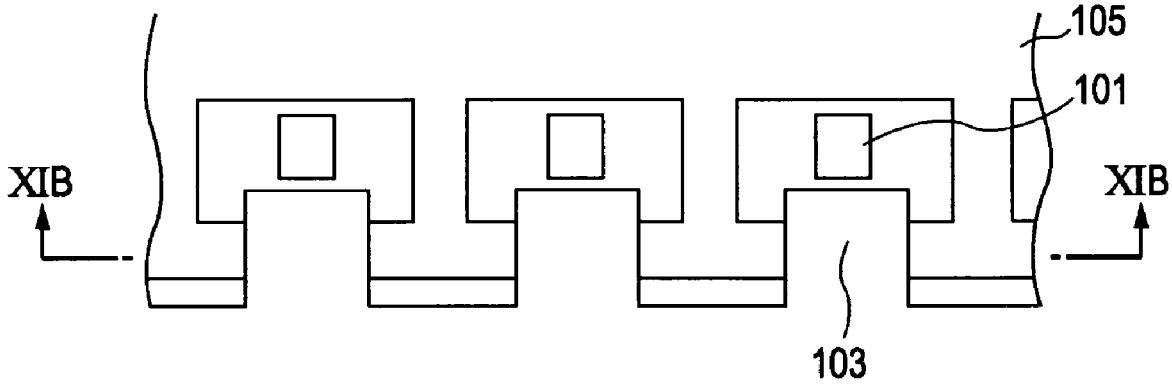
FIGS. 6A and 6B are diagrams illustrating the relationship between the width L1 of first flow channels and the width L2 of the second flow channels.
Figure 6B:
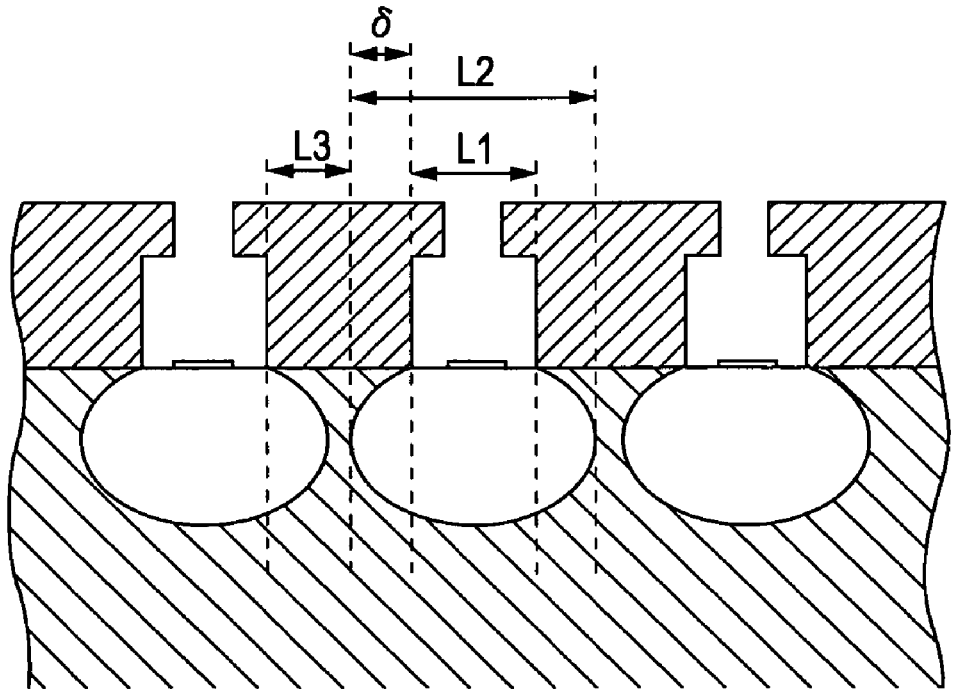
Figure 7:
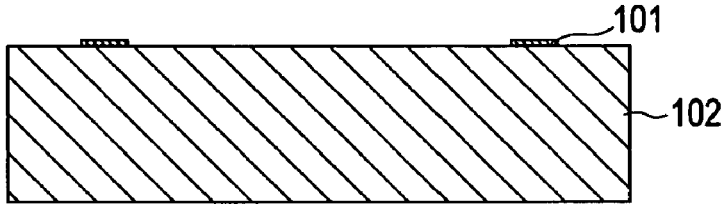
FIG. 7 is a sectional view taken in the same direction as FIG. 1, illustrating the initial step of a method for producing a liquid-ejection head according to a second embodiment of the present invention.

Referring to FIGS. 6A and 6B, the resultant head body satisfies $L1<L2$, wherein L1 is the width of the first flow channels 110 and L2 is the width of the second flow channels 103, and $L3>2\cdot\delta$, wherein L3 is the distance between the adjacent first flow channels 110 and $\delta(=(L2-L1)/2)$ is the difference between the width L1 of each first flow channel 110 and the width L2 of the corresponding second flow channel 103 on one side thereof.

Although not shown in the drawings, a plurality of head bodies having the structure described above may be simultaneously formed on a silicon wafer which constitutes the substrates 102 thereof. Finally, the wafer is cut by dicing to complete inkjet recording heads.

Second Embodiment

Figure 10A:
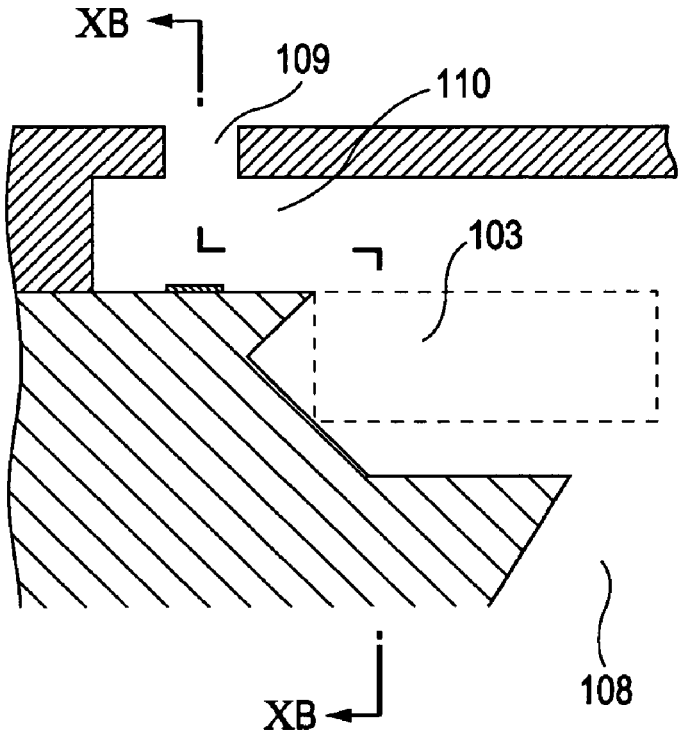
FIGS. 10A and 10B are sectional views of an inkjet head body having desired flow channels according to the second embodiment of the present invention.
Figure 10B:
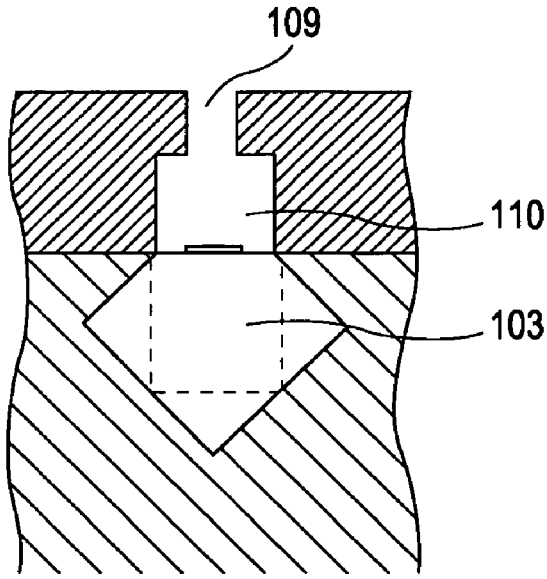

FIGS. 10A and 10B are schematic diagrams of an inkjet recording head according to a second embodiment of the present invention. This embodiment is different from the first embodiment in that the second flow channels 103 are defined by forming a recess perpendicularly through dry etching, as a first etching step, and anisotropically etching the recess through wet etching based on dependence on surface orientation, as a second etching step.

Figure 8A:
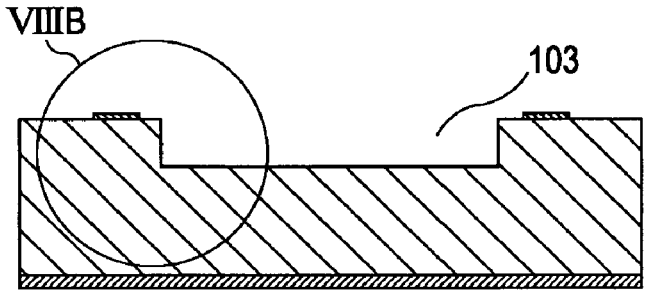
FIGS. 8A to 8C are diagrams of a substrate on which a recess is formed perpendicularly by dry etching.
Figure 8B:
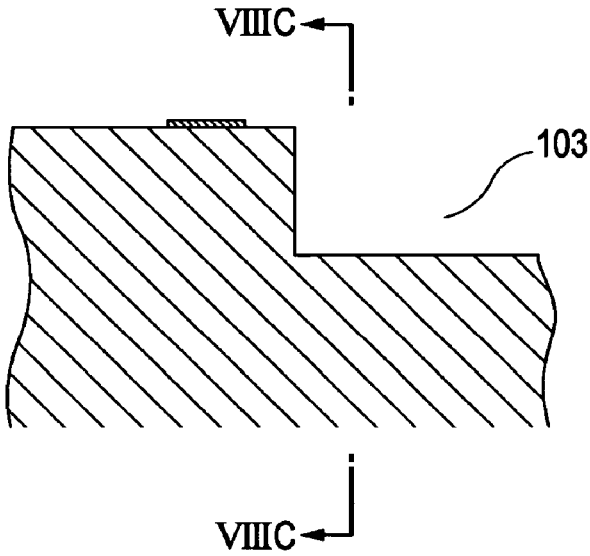
Figure 8C:
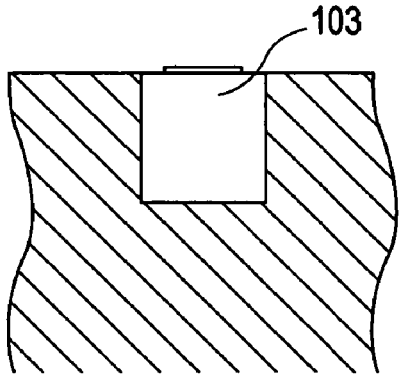

Referring to FIGS. 8A to 8C, as the first etching step, the substrate 102 is subjected to the deposition/etching process using an ICP dry etching apparatus to form a recess perpendicularly. The mask used for the dry etching may be a general novolac positive resist.

Figure 9A:
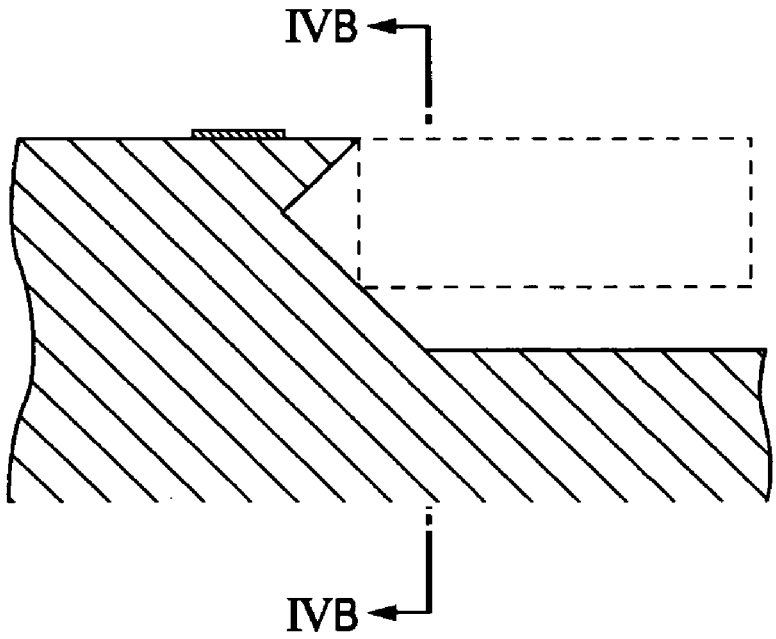
FIGS. 9A and 9B are diagrams of second flow channels formed by silicon crystal anisotropic etching.
Figure 9B:
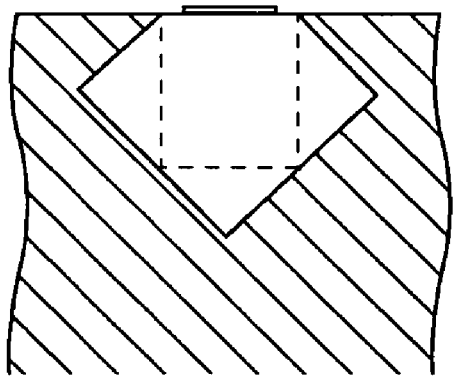

Referring to FIGS. 9A and 9B, as the second etching step, the second flow channels 103 can be defined by silicon crystal anisotropic etching in which the substrate 102 is dipped in a solution containing 22% by weight of tetramethylammonium hydride (TMAH) at 83° C. for one hour. A head body for the inkjet recording head according to this embodiment is produced after the same subsequent steps as in the first embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-150860 filed May. 24, 2005, which is hereby incorporated by reference herein in its entirety.

What is claimed is:

1. A liquid-ejection head comprising:

a substrate having a surface provided with an element for generating energy to be used for ejecting liquid from a discharge outlet;

a flow channel communicating with the discharge outlet corresponding to the element; and a supply port provided through the substrate from the flow channel to a back surface of the surface;

wherein the flow channel includes a first flow channel positioned above the surface and a second flow channel defined as a recessed portion of the surface, and positioned from an opening of the supply port in the surface to a near portion of the element, and wherein a section of the substrate in a direction orthogonal to a direction from an end of the supply port to the element has a part where a maximum width of the second flow channel is broader than a width of the flow channel at a part where the first flow channel communicates with the second flow channel.

2. A liquid-ejection head according to Claim 1, wherein in the section, the maximum width of the second flow channel is broader than a minimum width of the first flow channel.

* * * * *